United States Patent [19]

Adams et al.

[11] 4,177,745

[45] Dec. 11, 1979

[54] NEEDLE BAR GUIDE FOR A SEWING MACHINE

[75] Inventors: Kenneth D. Adams, Madison; Robert B. Brauch, Wayne, both of N.J.

[73] Assignee: The Singer Company, New York, N.Y.

[21] Appl. No.: 913,424

[22] Filed: Jun. 7, 1978

[51] Int. Cl.[2] ..... D05B 69/02

[52] U.S. Cl. ..... 112/221; 112/227

[58] Field of Search ..... 112/221, 227, 259, 256; 403/61, 115, 116

[56] References Cited

U.S. PATENT DOCUMENTS

| | | | |
|---|---|---|---|
| 2,676,043 | 4/1954 | Roethel | 403/61 |
| 2,682,846 | 7/1954 | Bell | 112/221 X |
| 3,031,990 | 5/1962 | Broedner | 112/256 |
| 3,187,700 | 6/1965 | Davy | 112/203 |
| 3,433,189 | 3/1969 | Weisz | 112/221 X |
| 3,713,407 | 1/1973 | Ciecior | 112/221 |
| 4,000,706 | 1/1977 | Kreissl et al. | 112/221 |
| 4,068,961 | 1/1978 | Ebner et al. | 403/116 |

FOREIGN PATENT DOCUMENTS

| | | | |
|---|---|---|---|
| 1049681 | 1/1959 | Fed. Rep. of Germany | 112/221 |
| 7516808 | 12/1976 | France | 112/259 |

*Primary Examiner*—Wm. Carter Reynolds

*Attorney, Agent, or Firm*—William V. Ebs; Robert E. Smith; Edward L. Bell

[57] ABSTRACT

A molded plastic guide provided in the head end mounting plate of a sewing machine receives the plastic toe of a latch carrier that is secured to a needle bar, and guides vertical reciprocatory movements of the needle bar.

4 Claims, 9 Drawing Figures

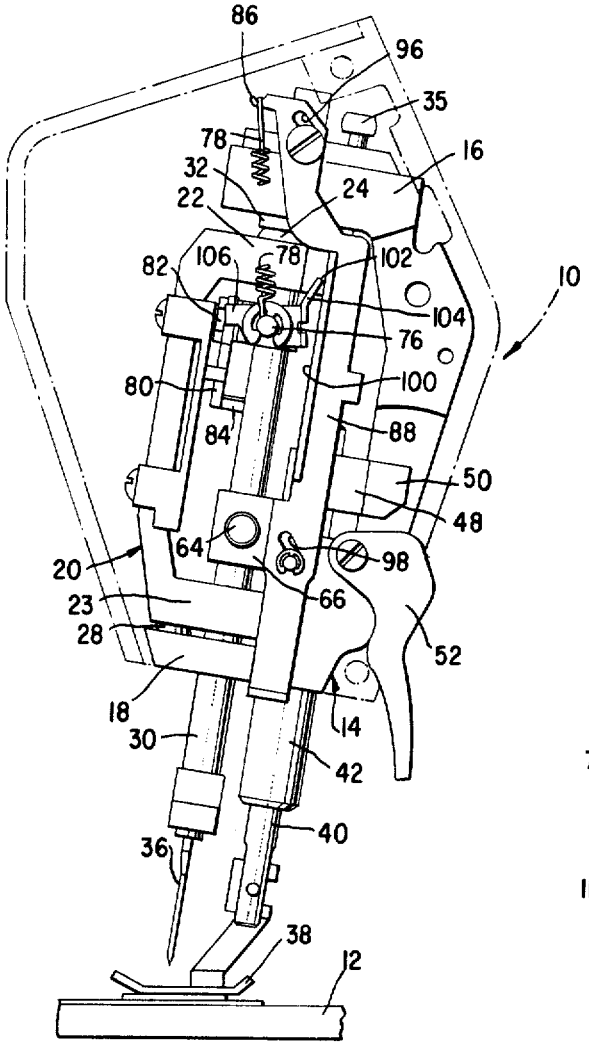
Fig. 4
Fig. 5
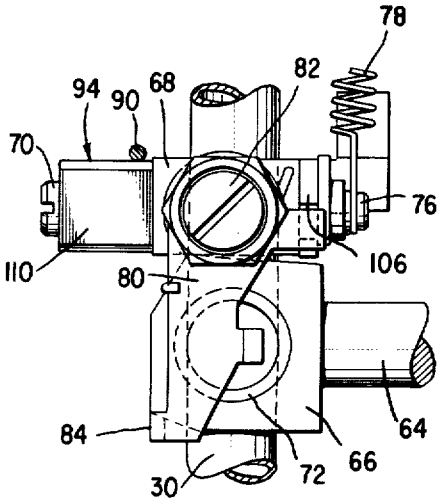
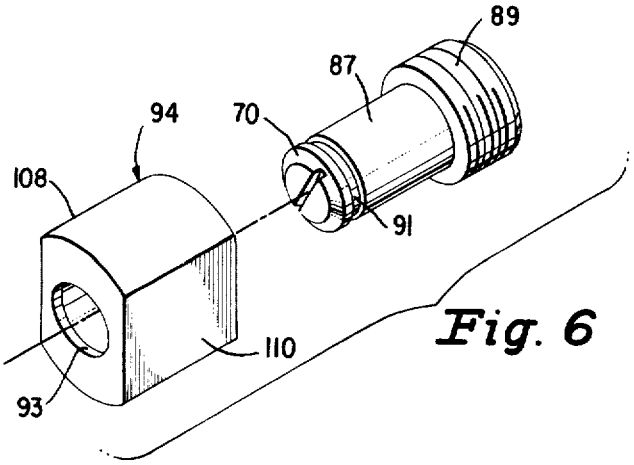
Fig. 6

NEEDLE BAR GUIDE FOR A SEWING MACHINE

BACKGROUND OF THE INVENTION

1. Field of the Invention

The invention relates to needle bar guiding means for a sewing machine.

2. Description of the Prior Art

Skip stitch sewing machines such as shown and described, for example in U.S. Pat. Nos. 3,793,969, 3,815,529, 3,872,809 and 4,000,706, of The Singer Company include a remotely controllable latch on a latch carrier which is secured to the needle bar of the machine. Such latch carrier is vertically reciprocable by cranking means, and includes means for guiding the reciprocating movements of the carrier to prevent rotation of the needle bar. During the operation of the machine the latch is operable to connect the carrier to and disconnect the carrier from the cranking means. The guiding means has generally included a vertical slot in a guide plate and an element on the latch carrier movable in such slot.

Difficulties with the latching operation have frequently been experienced due to the latch carrier being restrained at times by the guiding means in a position whereat a connection with the cranking means could not be readily effected. A further difficulty has been that of excessive wear on the engaging parts on the guiding means. Such difficulties have been due to excessive friction in the guiding means caused by limitations imposed by the prior art designs on the use of materials for the mutually engaging parts, and have also been due to the failure of the prior art guiding means to positively restrain angular movement of the latching means. The latching difficulties have been further aggravated in many prior art constructions by the required uses of a latch carrier and drive link aligning tang which interferred with the latching operation.

SUMMARY OF THE INVENTION

The latch carrier of a skip stitch machine is guided and constructed in accordance with the invention to facilitate latching of the latch carrier to associated cranking means. A molded plastic guide is provided in the head end mounting plate of the machine, and a flat sided plastic toe is provided on the latch carrier to engage planar side walls of a slot in the guide and define the angular orientation of the latch carrier at all times as well as the vertical path thereof during reciprocatory movements of the carrier by the cranking means. The guide and cooperating toe are of dissimilar plastic materials permitting the toe to move easily in a vertical direction in the guide, and the latch carrier to assume a defined vertical position when unlatched so that relatching can be readily effected. The usual tang provided on the latch carrier for the purpose of aligning the latch carrier and drive link is rendered unnecessary and eliminated.

DESCRIPTION OF THE DRAWINGS

FIG. 4 is an elevational view of the sewing head portion of the machine viewed from the interior of the machine in a direction opposite to that of FIG. 2, and showing the operation of detaching the needle bar from driving mechanism by manual means;

FIG. 5 is a detached and enlarged front elevational view showing the latching mechanism of the machine;

FIG. 6 is a perspective view showing a latch carrier guiding toe and associated securing element according to the invention;

DESCRIPTION OF THE PREFERRED EMBODIMENT

Figure 7:
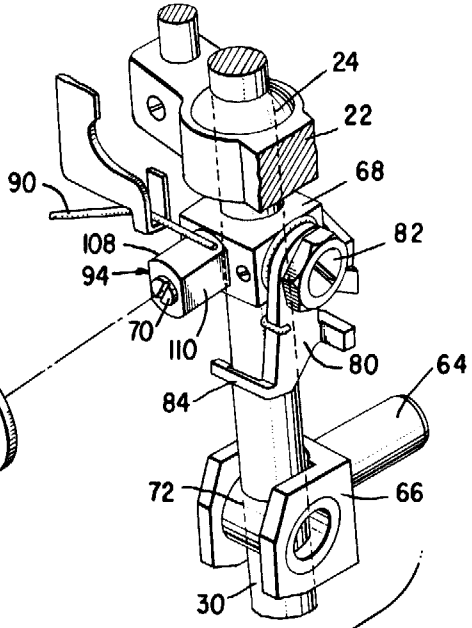
FIG. 7 is a detached and enlarged exploded perspective view showing the latch carrier guiding means of the invention.
Figure 8:
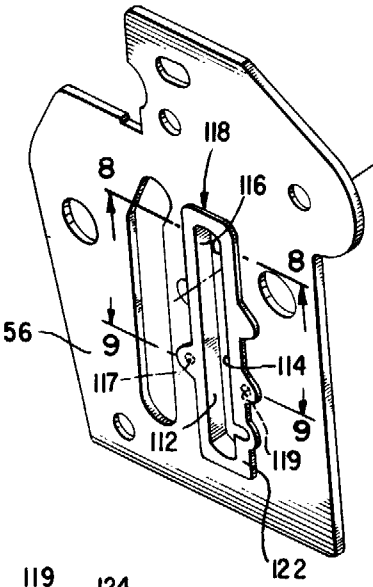
FIG. 8 is a fragmentary enlarged sectional view taken on the plane of the line 8—8 of FIG. 7.
Figure 8:
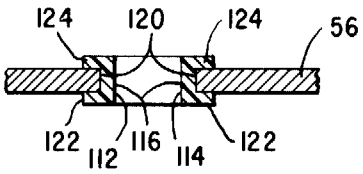
Figure 9:
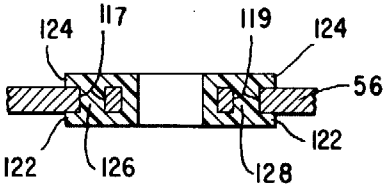
FIG. 9 is a fragmentary enlarged sectional view taken on the plane of the line 9—9 of FIG. 7.
Figure 1:
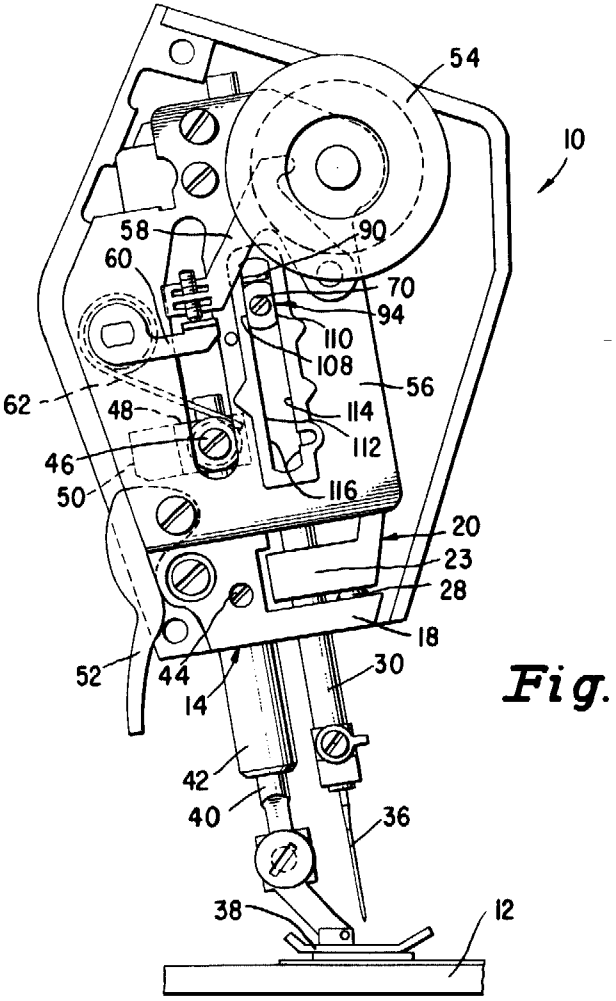
FIG. 1 is a head end elevational view of a skip-stitch sewing machine incorporating the invention and from which the end face plate of the machine has been removed.
Figure 3:
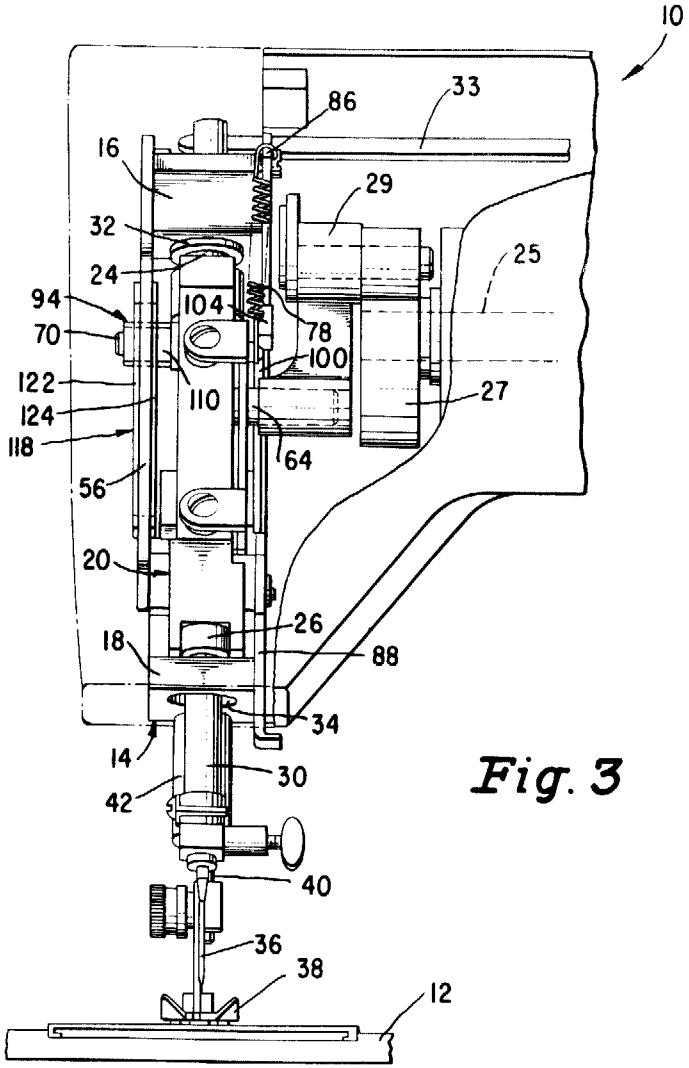
FIG. 3 is a front elevational view of the sewing head portion of the machine.
Figure 2:
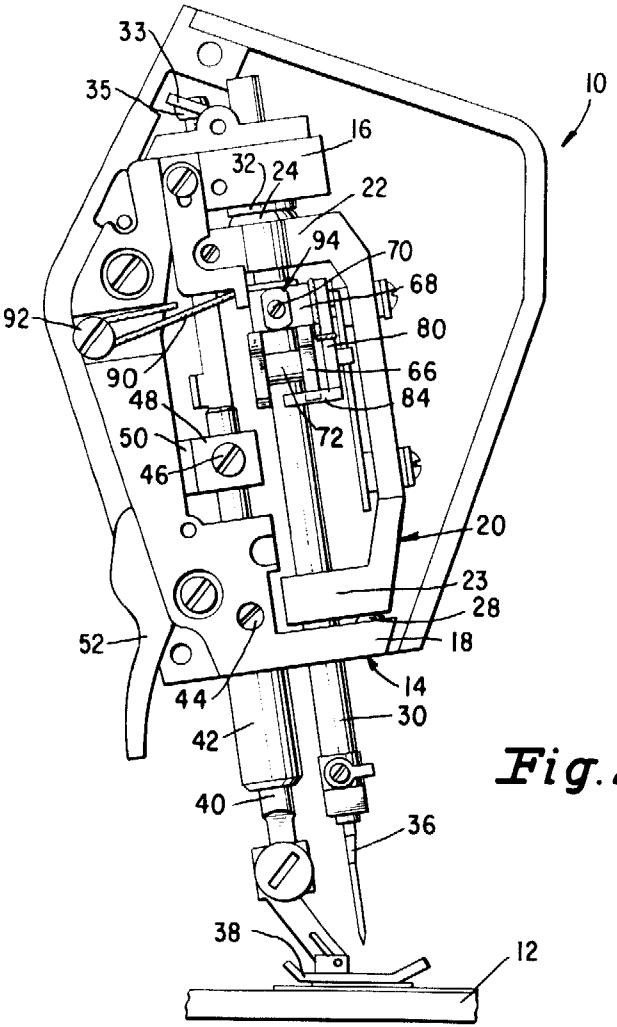
FIG. 2 is a view similar to FIG. 1 with the head end mounting plate removed.

Referring to the drawings, reference characters 10 and 12 designate the head end portion and a work supporting bed portion respectively of a skip-stitch sewing machine. The head end portion includes a fixed support bracket 14 having an upper extending arm 16 and a lower extending arm 18 wherein a gate 20 is journalled. Gate 20 includes an upper rearwardly extending arm 22 and lower rearwardly extending arm 23. Inserted in the upper arm of the gate 20 is an upper bearing having an outer spherical surface 24 and a coaxial internal bearing surface. Inserted into the lower arm of the gate is a bearing 26 having both an internal bearing surface and spaced therefrom a socket. A spherical headed rivet 28 affixed to the lower arm 18 of the support bracket 14 has its spherical head protruding into the socket of the lower bearing.

A needle bar 30 is supported for endwise reciprocation by a rotating arm shaft 25 acting through a crank 27 and link 29. As shown, the needle bar 30 is supported in the internal bearing surface of the upper bearing in the upper arm of the gate 20 and in the internal bearing surface of the lower bearing in the lower arm of the gate. A socket bearing 32, having an internal clearance hole for the needle bar 30, is slidably mounted in a bore in the upper arm 16 of the support bracket 14 and provides the socket for the outer spherical surface 24 of the upper bearing mounted in the upper arm 22 of gate 20. The needle bar 30 extends through an elongated opening 34 in the lower arm 18 of support bracket 14 which provides sufficient clearance for the needle bar to move laterally as required for zigzag sewing in response to oscillation of the gate 20 by cam mechanism (not shown) acting through linkage 33 on post 35.

Attached to the lower end of the needle bar 30 is a needle 36 which cooperates with a loop taker (not shown) in the bed portion 12 of the machine. A presser foot 38, affixed to a presser bar 40, is utilized to urge work material into contact with a feeding mechanism (not shown). The presser bar is journalled in a bearing 42 which is affixed in a bore in the support bracket 14 by a screw 44. The upper end of the presser bar 40 has affixed thereto by a screw 46, a presser bar guide block 48. Such guide block 48 has a tang portion 50 slidable in a slot between the support frame to prevent undesirable rotation of the presser foot 38. The tang portion 50 of the presser guide block 48 also co-acts with a presser bar lifting lever 52, journalled on the support bracket 14, to raise the presser foot from contact with the work material in the usual manner.

Pressure exerted by the foot 38 on work material is controllable by pressure regulating means of the type shown and described in U.S. Pat. No. 3,793,969 of The Singer Company. Such pressure regulating means includes a cam wheel 54 supported for turning movement on a head end mounting plate 56, operably associated levers 58 and 60 pivotally supported on the plate 56, and a spring 62 which may be caused to bear with more or less force against a wheel affixed to block 48 as cam wheel 54 is turned in one direction or the other.

As shown, link 29 fixedly connects through a driving stud 64 with a drive link 66 which may be latched to or unlatched from a latch carrier block 68 that is affixed to the needle bar 30 by a screw 70. The drive link 66 includes a collar 72 freely slidable on the needle bar 30 when the drive link 66 is unlatched from the block 68. On the opposite side of block 68 from screw 70, a pin 76 is supported, protruding sufficiently to catch the hook end of an extension spring 78. On the forwardly disposed face of the block 68, a latch 80 pivots on a shouldered screw 82. The latch 80 is fashioned with a rearwardly directed latch finger 84 to extend beneath and clasp the drive link 66 to the block 68 affixed to the needle bar. A second hook end of the extension spring 78 is attached to the uppermost corner 86 of a latch release member 88. The spring 78 serves to maintain the latch release member 88 in its downward position unless urged upwardly, and also lifts the latch carrier block 68 and needle bar 30 to an elevated position whenever the latch 80 is disengaged from link 66. A resilient abutment means 90 secured by a screw 92 to support bracket 14 and engageable with a toe 94 affixed to block 68 serves to limit the height to which the latch carrier and needle bar may be carried, and to thereby facilitate relatching of the needle bar to the endwise reciprocatory driving mechanism. As shown toe 94 mounts on a stub shaft 87 which is threaded at 89 to screw into block 68. A force fit is provided for the toe on stub shaft 87 which is grooved at 91 to receive a circular ridge 93 within the toe.

Normally the drive link 66 is latched to block 68 and the needle bar is reciprocated by the associated driving means. However, when the latch release member 88 is elevated it is caused to move forwardly due to the configuration of cam slots 96 and 98. The forward edge 100 of member 88 acting on an abutting end 102 of a lever 104 causes such lever cooperating with the ear 106 of the latch 80 to rotate the latch and disconnect the latch carrier 68 from drive link 66. The needle bar 30 is then elevated by the tension spring 78 as restrained by abutment means 90.

The toe 94 is formed with flat sides 108 and 110 which engage planar side edges 112 and 114 respectively of an elongated slot 116 extending through head end mounting plate 56. The orientation of the needle bar 30 is thereby definitely defined even when disconnected from drive link 66.

Slot 116 is located in a guide 118 which is a molded plastic part formed in the head end mounting plate 56. The plate is of sheet metal and the guide is formed around an elongated opening 120 in the plate as well as through holes 117 and 119 provided in the plate on opposite sides of the slot. As shown the guide is formed with marginal flanges 122 and 124 that overlie the plate on opposite sides. Such marginal flanges prevent movement of the guide in a direction perpendicular to the plane of plate. Plastic portions 126 and 128 of the guide extending through holes 117 and 119 respectively in the plate prevent warpage of the guide in the plane of the plate and so serve to keep planar side edges 112 and 114 parallel. Toe 94 which engages the sides of slot 116 is also plastic, but is of a different plastic material than guide 118, different plastic materials being used because less rubbing friction and less abrasion is obtainable between different plastics. Plastics having low coefficients of friction are selected for the guide 118 and toe 94 and because of the greater area of contact on the guide, it is desirable in the interest of equalizing wear on the contacting parts to use the softer of the two materials on the guide. It is also preferable that at least the material of the guide be one of the chemically self lubricating plastics. Plastic materials particularly suited for the guide are Dupont's "DEBRIN" 500Cl and Celenese's "CELCON" M90-04. Plastic materials especially suited for the toe are General Electric's "Volax" 310 and Celenese's "CELENESE" 2011. During construction of the sewing machine, of which the head end portion has been herein described, silicone grease is applied as a lubricant to the guide 118 and toe 94 to reduce friction between these parts to a minimum.

With the guide 118 and engaging toe 94 as described, the latch carrier 68 is always caused by springs 78 and 90 when disconnected from drive link 66 to assume a precisely defined vertical position wherein it may be readily connected to the latch carrier, friction between the toe 94 and sides of slot 116 in guide 118 being so slight as to exert no interferring effect of consequence preventing the latch carrier from assuming a position of equilbrium between the springs. The flat-sided engagement between the toe 94 and sides of slot 116 prevents any twisting of the latch carrier into a position interferring with relatching of the latch carrier 68 to the drive link 66, and serves to reduce wear on the engaging surfaces of the toe and slot during reciprocatory movements of the latch carrier by the drive link. Possible angular misalignment of the latch carrier and drive link being minimized, the need for an aligning tang depending from the latch carrier as shown for example in U.S. Pat. No. 3,872,809 is avoided, and any interference with relatching such as sometimes resulted from the presence of the tang is prevented.

The toe 94 and guide 118 are parts which are readily and economically producible utilizing conventional plastic molding techniques. No machining of these parts is required, and the metal head end mounting plate 56 only need be punched out to provide a roughly dimensioned slot around which the plastic guide 118 can be formed.

The foregoing disclosure is representative of a preferred exemplary form and adaptation of the invention, and is to be interpreted as illustrative rather than limiting. It is intended that the invention be accorded the full scope of the claims appended hereto.

Having thus set forth the nature of the invention, what is claimed herein is:

1. In a skip-stitch type sewing machine, the combination including a needle bar, a latch carrier secured to the needle bar, cranking means attachable to and detachable from the latch carrier for reciprocating the carrier and needle bar when connected thereto, a plastic toe affixed to the latch carrier, and a fixed head end mounting plate including a molded plastic guide with an elongated slot having opposite planar sides, said plastic guide including marginal flanges extending therearound which contact opposite sides of the plate and prevent movement of the guide in a direction perpendicular to the plate, the toe having opposite flat sides which engage the opposite planar sides of the slot to angularly orient the latch carrier and to define the path of the latch carrier during reciprocation of the latch carrier by the cranking means, the toe and guide being of dissimilar compositions and the molded plastic guide being of a softer material than the toe.

2. The combination of claim 1 wherein the plate is provided with through holes, and integral molded portions of the plastic guide extend through such holes to prevent warpage of the guide in the plane of the plate.

3. The combination of claim 1 wherein at least one of said dissimilar compositions is self lubricating.

4. The combination of claim 1 wherein the guide is self lubricating.

* * * * *